US006777886B1

(12) United States Patent
Lo et al.

(10) Patent No.: US 6,777,886 B1
(45) Date of Patent: Aug. 17, 2004

(54) DIGITAL DRIVING METHOD AND APPARATUS FOR ACTIVE MATRIX OLED

(75) Inventors: Shin-Tai Lo, Miaoli (TW); Yung-Chou Chan, Changhua (TW); Chih-Chung Chien, Taichung (TW)

(73) Assignee: Windell Corporation, Taichung (TW)

( * ) Notice: Subject to any disclaimer, the term of this patent is extended or adjusted under 35 U.S.C. 154(b) by 0 days.

(21) Appl. No.: 10/408,116

(22) Filed: Apr. 8, 2003

(51) Int. Cl.[7] ..... G09G 3/10

(52) U.S. Cl. ..... 315/169.1; 315/169.3; 345/76; 345/77

(58) Field of Search ..... 315/169.1, 169.3; 345/76, 77

(56) References Cited

U.S. PATENT DOCUMENTS 6,441,560 B1 * 8/2002 Hunter ..... 315/169.1

6,674,245 B2 * 1/2004 Ko et al. ..... 315/169.3

* cited by examiner

*Primary Examiner*—David Vu

(74) *Attorney, Agent, or Firm*—Birch, Stewart, Kolasch & Birch, LLP

(57) ABSTRACT

A digital driving method and apparatus for active matrix organic light emitting diode mainly includes a plurality of pixel structures. Program display separated driving scheme is achieved by controlling the electric potential of the supply line. During the image data program period, the electric potential of the supply line is held at zero potential (GND) to disable the OLED from lighting. When to display the image data, the supply line is connected to a positive electric potential to allow the OLED to light.

10 Claims, 3 Drawing Sheets

DIGITAL DRIVING METHOD AND APPARATUS FOR ACTIVE MATRIX OLED

FIELD OF THE INVENTION

The present invention relates to a digital driving method and apparatus for active matrix organic light emitting diode (AMOLED) and particularly a digital driving method and pixel structures that achieve the program-display-separated driving scheme by controlling the electric potential of the supply line.

BACKGROUND OF THE INVENTION

The known TFT technologies at present can be classified in amorphous silicon TFT (a-Si TFT) and Poly-Si TFT. The generally called TFT-LCD is a-Si TFT which is technically well developed and is the main stream of LCD products. The main difference between the low temperature Poly-Si TFT (LTPS TFT) and the a-Si TFT is that the LTPS transistor requires a laser annealing during the manufacturing process to transform the thin film of amorphous silicon to poly silicon thin film so that the silicon structure of the LTPS is more organized than a-Si TFT. It can increase electron mobility up to 200 $cm^2$/V-sec. The LTPS technology enables elements to be made in a smaller size. The size of the whole TFT element can be shrunk 50% or more. The aperture ratio may also be improved. Comparing with a-Si TFF of the same dimension, LTPS TFT has a higher resolution and lower power consumption. On design consideration, the driver module or a portion of Driver IC may be directly integrated on the glass substrate. This helps to reduce the size and element number required on the circuit board, and reduce the connection between the driver IC and the electrodes of the panel. As a result, circuit cost decreases. In addition, during packaging processes in the later stage of production, product damage may be reduced, and production yield increases, and production cost is lower. Moreover, as a portion of the driver IC is integrated, IC weight is reduced. Materials required in the assembly at the later production stage is less, and total weight may be greatly reduced. Furthermore, LTPS TFT has other advantages such as power saving, greater light intensity, finer picture, thin and light, fewer connection points (less than 200 connection points, that improves yields, while a-Si TFT has more than 3842 connection points).

However, during the manufacturing process of LTPS the properties of thin film transistor will change. When the driver system uses analog modulation method to display gray scale, the TFT often results in different properties after laser annealing process. Hence even if signals of the same voltage are programmed, the OLEDs of different pixels generate different current and produce different light intensity. This phenomenon tends to make the OLED panel to display erroneous gray scale images and severely damage image uniformity.

SUMMARY OF THE INVENTION

Therefore the primary object of the invention is to resolve the aforesaid disadvantages. The invention provides a digital driving method and pixel structures that achieve the program-display-separated driving scheme by controlling the electric potential of the supply line. During the image data program period, the electric potential of the supply line 7 is held at zero potential (GND) to disable the OLED 4 from lighting. When to display the image data, the supply line is connected to a positive electric potential to allow the OLED to light.

The foregoing, as well as additional objects, features and advantages of the invention will be more readily apparent from the following detailed description, which proceeds with reference to the accompanying drawings.

DESCRIPTION OF THE PREFERRED EMBODIMENTS

Figure 1B:
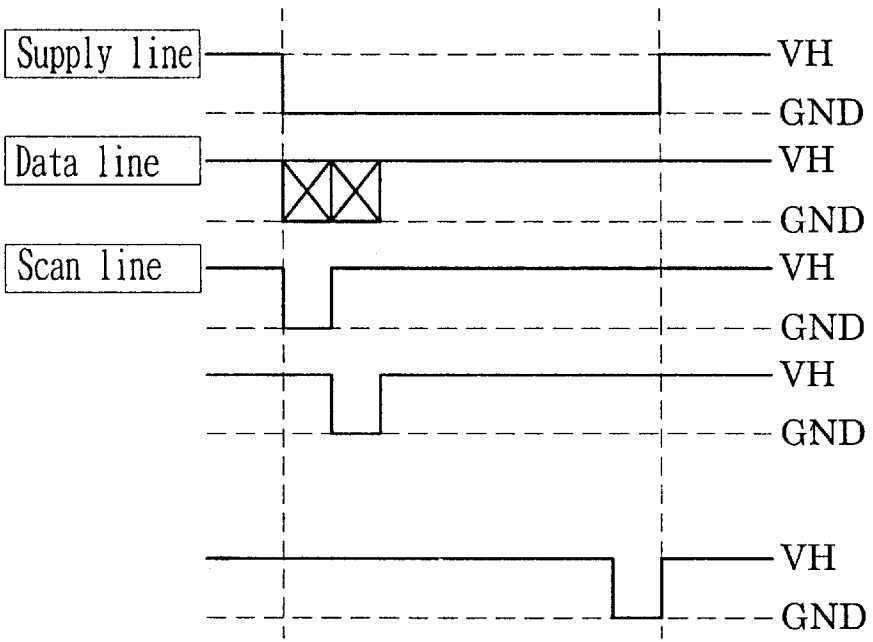
FIG. 1B shows a timing diagram for the driving operation used with the AMOLED pixel structure of FIG. 1A.
Figure 1A:
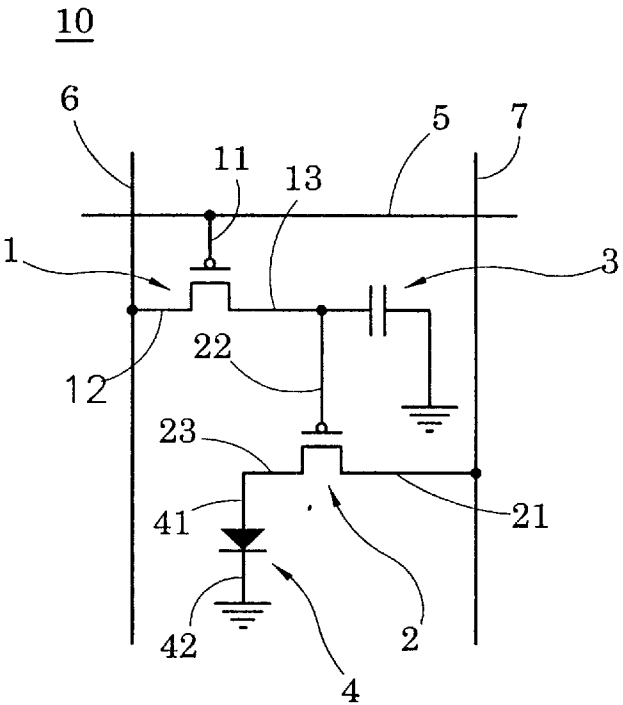
FIG. 1A shows a circuit diagram of a first embodiment of an AMOLED pixel structure in accordance with the present invention.

Refer to FIG. 1A for the circuit of a first embodiment of an AMOLED pixel structure in accordance with the present invention. Because it is contemplated that each pixel structure in a given array of pixels (e.g., 176×144) is the same, only a circuit 10 of a single pixel structure is described. The pixel configuration shown in FIG. 1A is operated digitally to achieve the program-display-separated driving scheme by controlling the electric potential of the supply line 7. Therefore, the luminance of AMOLED can be independent of the variation in the transistor threshold voltage and mobility.

As shown in FIG. 1A, the pixel circuit 10 contains a switch unit 1, a driver unit 2, a storage unit 3 and an OLED 4.

The switch unit 1 may be a P-channel TFT that has two inputs 11 and 12 connecting respectively to a scan line 5 and a data line 6.

The driver unit 2 may be a P-channel TFT that has an input 21 connecting to a supply line 7 and the other input 22 connecting to an output 13 of the switch unit 1.

The storage unit 3 consists of a capacitor that has one end grounded and the other end connecting to the juncture of the output 13 of the switch unit 1 and the input 22 of the driver unit 2.

The OLED 4 has an input 41 connecting to the output 23 of the driver unit 2 and an output 42 grounded.

Refer to FIG. 1B for the driving voltage waveform of a first embodiment of an AMOLED pixel structure in accordance with the present invention. During the program period, the electric potential of the supply line 7 is held at zero potential (GND) to disable the OLED 4 from lighting. The scan line 5 for the selected row is made logic-low (zero voltage GND), and the scan lines for the other rows are made logic-high (a positive voltage VH).

The switch unit 1 can be turned on when the scan line 5 is made logic-low. The data line 6 is connected to the storage unit 3 through the switch unit 1 and, therefore, the established voltage level of the data line 6 can be stored into the storage unit 3. If the image data of the pixel is ON, zero voltage GND is stored in the storage unit 3. On the other hand, if the image data of the pixel is OFF, a positive voltage VH is stored in the storage unit 3.

After the scanning operations for all rows are completed, the electric potential of the supply line 7 is connected to the positive potential VH, and thereby the OLED 4 of the pixel circuit 10 with the storage unit 3 stored at zero voltage GND can generate light, and the OLED 4 of the pixel circuit 10 with the storage unit 3 stored at a positive voltage VH can not generate light.

Figure 2B:
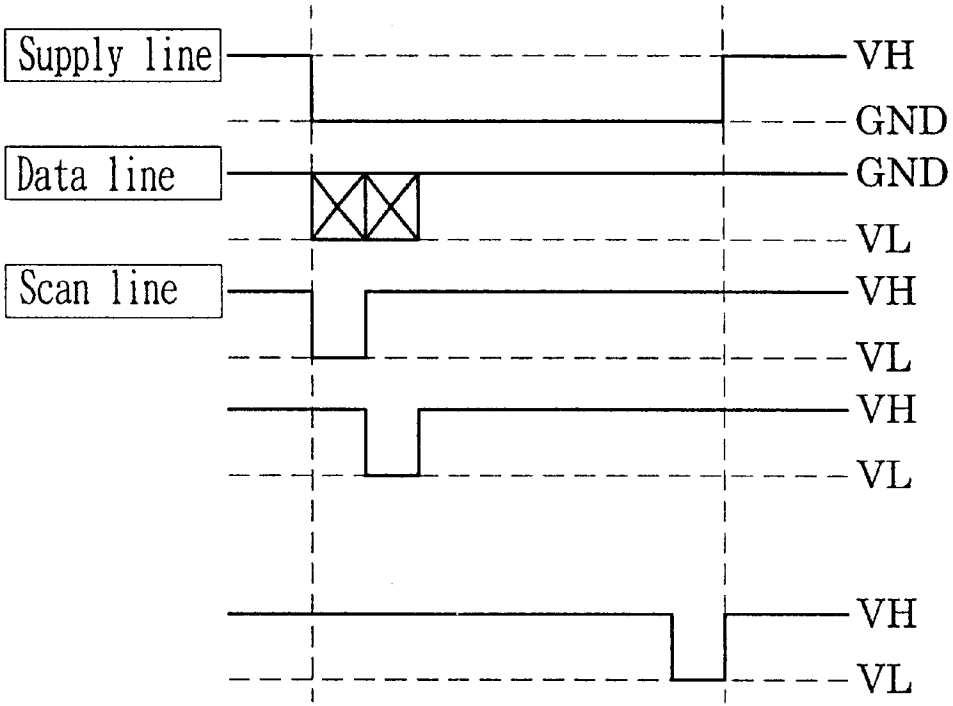
FIG. 2B shows a timing diagram for the driving operation used with the AMOLED pixel structure of FIG. 2A.
Figure 2A:
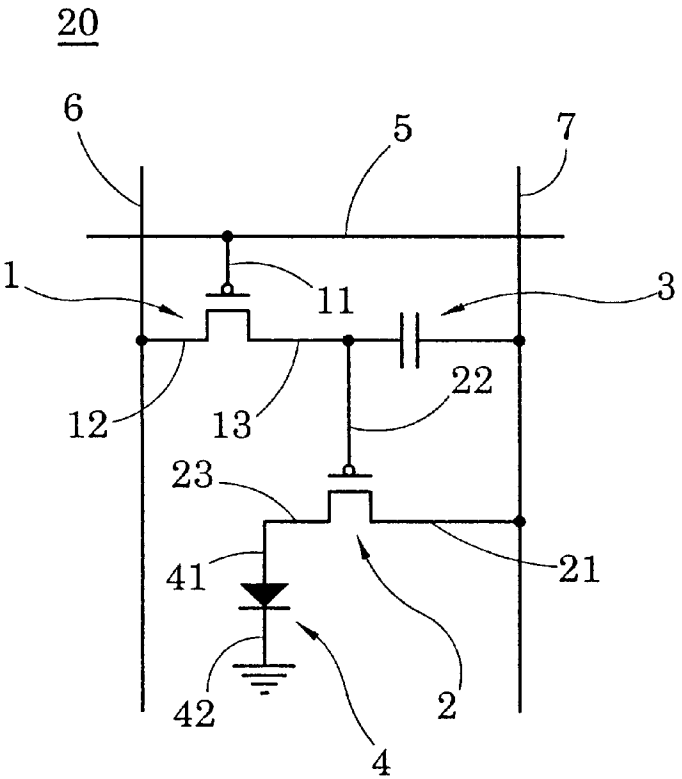
FIG. 2A shows a circuit diagram of a second embodiment of an AMOLED pixel structure in accordance with the present invention.

Refer to FIG. 2A for the circuit of a second embodiment of an AMOLED pixel structure in accordance with the present invention. Because it is contemplated that each pixel structure in a given array of pixels (e.g., 176×144) is the same, only a circuit 20 of a single pixel structure is described. The pixel configuration shown in FIG. 2A is operated digitally to achieve the program-display-separated driving scheme by controlling the electric potential of the supply line 7. Therefore, the luminance of AMOLED can be independent of the variation in the transistor threshold voltage and mobility.

As shown in FIG. 2A, the pixel circuit 20 contains a switch unit 1, a driver unit 2, a storage unit 3 and an OLED 4.

The switch unit 1 may be a P-channel TFT that has two inputs 11 and 12 connecting respectively to a scan line 5 and a data line 6.

The driver unit 2 may be a P-channel TFT that has an input 21 connecting to a supply line 7 and the other input 22 connecting to an output 13 of the switch unit 1.

The storage unit 3 consists of a capacitor that has one end connecting to a supply line 7 and the other end connecting to the juncture of the output 13 of the switch unit 1 and the input 22 of the driver unit 2.

The OLED 4 has an input 41 connecting to the output 23 of the driver unit 2 and an output 42 grounded.

Refer to FIG. 2B for the driving voltage waveform of a second embodiment of an AMOLED pixel structure in accordance with the present invention. During the program period, the electric potential of the supply line 7 is held at zero potential (GND) to disable the OLED 4 from lighting. During the program period, the electric potential of the supply line 7 is held at zero potential (GND) to disable the OLED 4 from lighting. The scan line 5 for the selected row is made logic-low (a negative voltage VL), and the scan lines for the other rows are made logic-high (a positive voltage VH).

The switch unit 1 can be turned on when the scan line 5 is made logic-low. The data line 6 is connected to the storage unit 3 through the switch unit 1 and, therefore, the established voltage level of the data line 6 can be stored into the storage unit 3. If the image data of the pixel is ON, a negative voltage VL is stored in the storage unit 3. On the other hand, if the image data of the pixel is OFF, zero voltage GND is stored in the storage unit 3.

After the scanning operations for all rows are completed, the electric potential of the supply line 7 is connected to the positive potential VH, and thereby the OLED 4 of the pixel circuit 10 with the storage unit 3 stored at a negative voltage VL can generate light, and the OLED 4 of the pixel circuit 10 with the storage unit 3 stored at zero voltage GND can not generate light.

Figure 3B:
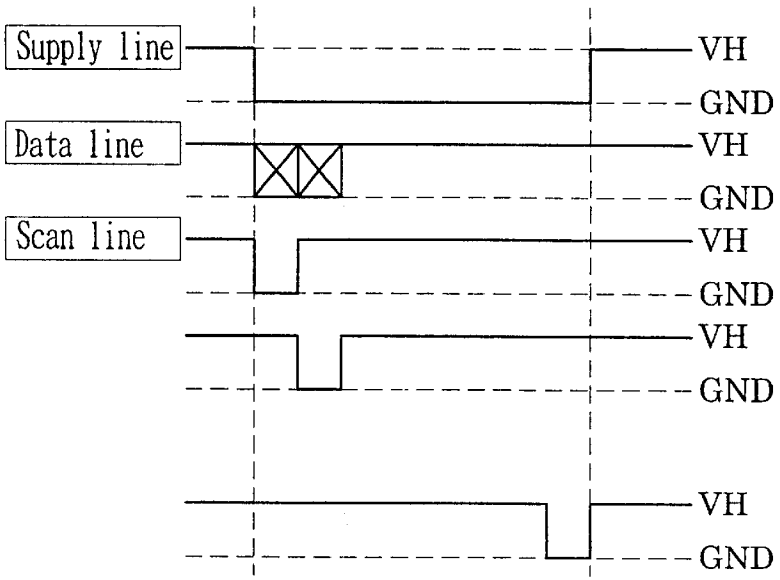
FIG. 3B shows a timing diagram for the driving operation used with the AMOLED pixel structure of FIG. 3A.
Figure 3A:
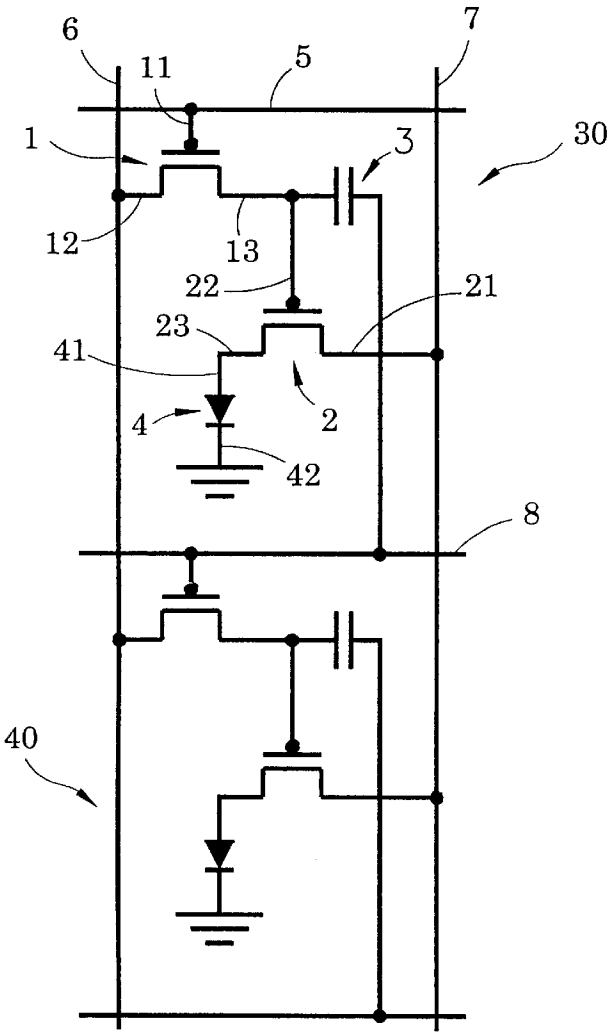
FIG. 3A shows a circuit diagram of a third embodiment of an AMOLED pixel structure in accordance with the present invention.

Refer to FIG. 3A for the circuit of a second embodiment of an AMOLED pixel structure in accordance with the present invention. Because it is contemplated that each pixel structure in a given array of pixels (e.g., 176×144) is the same, only a circuit 30 of a single pixel structure and a circuit 40 of a neighboring pixel structure are described. The pixel configuration shown in FIG. 3A is operated digitally to achieve the program-display-separated driving scheme by controlling the electric potential of the supply line 7. Therefore, the luminance of AMOLED can be independent of the variation in the transistor threshold voltage and mobility.

As shown in FIG. 3A, the pixel circuit 30 contains a switch unit 1, a driver unit 2, a storage unit 3 and an OLED 4.

The switch unit 1 may be a P-channel TFT that has two inputs 11 and 12 connecting respectively to a scan line 5 and a data line 6.

The driver unit 2 may be a P-channel TFT that has an input 21 connecting to a supply line 7 and the other input 22 connecting to an output 13 of the switch unit 1.

The storage unit 3 consists of a capacitor that has one end connecting to the juncture of the output 13 of the switch unit 1 and the input 22 of the driver unit 2 and the other end connecting to a scan line 8 of the neighboring pixel circuit 40.

The OLED 4 has an input 41 connecting to the output 23 of the driver unit 2 and an output 42 grounded. Refer to FIG. 3B for the driving voltage waveform of a third embodiment of an AMOLED pixel structure in accordance with the present invention. During the program period, the electric potential of the supply line 7 is held at zero potential (GND) to disable the OLED 4 from lighting. The scan line 5 for the selected row is made logic-low (zero voltage GND), and the scan lines for the other rows are made logic-high (a positive voltage VH).

The switch unit 1 can be turned on when the scan line 5 is made logic-low. The data line 6 is connected to the storage unit 3 through the switch unit 1 and, therefore, the established voltage level of the data line 6 can be stored into the storage unit 3. If the image data of the pixel is ON, zero voltage GND is stored in the storage unit 3. On the other hand, if the image data of the pixel is OFF, a positive voltage VH is stored in the storage unit 3.

After the scanning operations for all rows are completed, the electric potential of the supply line 7 is connected to the positive potential VH, and thereby the OLED 4 of the pixel circuit 10 with the storage unit 3 stored at zero voltage GND can generate light, and the OLED 4 of the pixel circuit 10 with the storage unit 3 stored at a positive voltage VH can not generate light.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A digital driving apparatus for active matrix organic light emitting diode (OLED) which consists of a plurality of pixel circuits (10), each of the pixel circuits comprising:

a switch unit having two input ends and an output end, the two input ends connecting respectively to a data line and a scan line;

a driver unit having two input ends and an output end, the two input ends connecting respectively to a supply line and the output end of the switch unit;

a storage unit having one end grounded and another end connecting to a juncture of the output end of the switch unit and the input end of the driver unit; and an OLED having an input end connecting to the output end of the driver unit and an output end grounded;

wherein when the pixel circuits scans image data the electric potential of the supply line is connected to zero potential to disable the OLED from lighting and the switch unit is conductive, and the image data enter from the data line into the switch unit; after being scanned by the scan line, the image data are stored in the storage unit, and a zero electric potential is stored in the storage unit when the image data are lighting, otherwise a positive electric potential is stored in the storage unit when the image data are not lighting, and the electric potential of the supply line is connected to the positive electric potential after all scanning operations are completed to allow the OLED of the pixel circuits which has the storage unit at the zero voltage to light.

2. The digital driving apparatus for active matrix organic light emitting diode of claim 1, wherein the electric potential of the scan line during the scanning operations is zero potential and the electric potential of other scanning lines is a positive potential.

3. The digital driving apparatus for active matrix organic light emitting diode of claim 1, wherein the switch unit and the driver unit are P-channel thin film transistors (TFTs).

4. The digital driving apparatus for active matrix organic light emitting diode of claim 1, wherein the storage unit consists of capacitors.

5. A digital driving apparatus for active matrix organic light emitting diode which consists of a plurality of pixel circuits (20), each of the pixel circuits comprising:

a switch unit having two input ends and an output end, the two input ends connecting respectively to a data line and a scan line;

a driver unit having two input ends and an output end, the two input ends connecting respectively to a supply line and the output end of the switch unit;

a storage unit having one end connecting to the supply line and another end connecting to a juncture of the output end of the switch unit and the input end of the driver unit; and an OLED having an input end connecting to the output end of the driver unit and an output end grounded;

wherein when the pixel circuits scans image data the electric potential of the supply line is connected to zero potential to disable the OLED from lighting and the switch unit is conductive, and the image data enter from the data line into the switch unit; after being scanned by the scan line, the image data are stored in the storage unit, and a negative electric potential is stored in the storage unit when the image data are lighting, otherwise a zero electric potential is stored in the storage unit when the image data are not lighting, and the electric potential of the supply line is connected to a positive electric potential after all scanning operations are completed to allow the OLED of the pixel circuits which has the storage unit at the negative voltage to light.

6. The digital driving apparatus for active matrix organic light emitting diode of claim 5, wherein the electric potential of the scan line during the scanning operations is a negative potential and the electric potential of other scanning lines is a positive potential.

7. A digital driving apparatus for active matrix organic light emitting diode which consists of a plurality of pixel circuits (30), each of the pixel circuits comprising:

a switch unit having two input ends and an output end, the two input ends connecting respectively to a data line and a scan line;

a driver unit having two input ends and an output end, the two input ends connecting respectively to a supply line and the output end of the switch unit;

a storage unit having one end connecting to a juncture of the output end of the switch unit and the input end of the drive unit and another end connecting to a scan line of the neighboring pixel circuits (40); and an OLED having an input end connecting to the output end of the driver unit and an output end grounded;

wherein when the pixel circuits scans image data the electric potential of the supply line is connected to zero potential to disable the OLED from lighting and the switch unit is conductive, and the image data enter from the data line into the switch unit; after being scanned by the scan line, the image data are stored in the storage unit, and a zero electric potential is stored in the storage unit when the image data are lighting, otherwise a positive electric potential is stored in the storage unit when the image data are not lighting, and the electric potential of the supply line is connected to the positive electric potential after all scanning operations are completed to allow the OLED of the pixel circuits which has the storage unit at the zero voltage to light.

8. The digital driving apparatus for active matrix organic light emitting diode of claim 7, wherein the electric potential of the scan line during the scanning operations is zero potential and the electric potential of other scanning lines is a positive potential.

9. A digital driving method for active matrix organic light emitting diode that consists of a plurality of pixel circuits, comprising steps of:

connecting the electric potential of a supply line to zero potential when image data are input to each of the pixel circuits to disable an OLED from displaying; and connecting the electric potential of the supply line to a positive electric potential (VH) when the image data are output to allow the OLED to display.

10. The digital driving method for active matrix organic light emitting diode of claim 9, wherein the OLED of every pixel circuits shares a same cathode which is grounded.

* * * * *